US006422810B1

(12) United States Patent
Burdgick et al.

(10) Patent No.: US 6,422,810 B1
(45) Date of Patent: Jul. 23, 2002

(54) EXIT CHIMNEY JOINT AND METHOD OF FORMING THE JOINT FOR CLOSED CIRCUIT STEAM COOLED GAS TURBINE NOZZLES

(75) Inventors: Steven Sebastian Burdgick; James Lee Burns, both of Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/578,006

(22) Filed: May 24, 2000

(51) Int. Cl.[7] ..... F01D 5/14
(52) U.S. Cl. ..... 415/115; 415/116
(58) Field of Search ..... 415/115, 116, 415/178; 29/889.21, 889.22

(56) References Cited

U.S. PATENT DOCUMENTS 5,120,192 A * 6/1992 Ohtomo et al. ..... 415/115
5,743,708 A * 4/1998 Cunha et al. ..... 415/115
6,019,572 A * 2/2000 Cunha et al. ..... 415/114
6,036,436 A * 3/2000 Fukuno et al. ..... 415/115

* cited by examiner

*Primary Examiner*—Edward K. Look
*Assistant Examiner*—Ninh Nguyen
(74) *Attorney, Agent, or Firm*—Nixon & Vanderhye

(57) ABSTRACT

A nozzle segment for a gas turbine includes inner and outer band portions and a vane extending between the band portions. The inner and outer band portions are each divided into first and second plenums separated by an impingement plate. Cooling steam is supplied to the first cavity for flow through the apertures to cool the outer nozzle wall. The steam flows through a leading edge cavity in the vane into the first cavity of the inner band portion for flow through apertures of the impingement plate to cool the inner nozzle wall. Spent cooling steam flows through a plurality of cavities in the vane, exiting through an exit chimney in the outer band. The exit chimney is secured at its inner end directly to the nozzle vane wall surrounding the exit cavities, to the margin of the impingement plate at a location intermediate the ends of the exit chimney and to margins of an opening through the cover whereby each joint is externally accessible for joint formation and for subsequent inspection.

6 Claims, 4 Drawing Sheets

EXIT CHIMNEY JOINT AND METHOD OF FORMING THE JOINT FOR CLOSED CIRCUIT STEAM COOLED GAS TURBINE NOZZLES

This invention was made with Government support under Contract No. DE-FC21-95MC31176 awarded by the Department of Energy. The Government has rights in this invention.

BACKGROUND OF THE INVENTION

The present invention relates to nozzle segments for use in gas turbines employing a closed circuit cooling system and particularly relates to an exit chimney joint with the outer band of a nozzle segment and methods of forming the joint.

In current gas turbine designs, nozzle segments are typically arranged in an annular array about the rotary axis of the turbine. The array of segments forms outer and inner annular bands and a plurality of circumferentially spaced, generally radially extending vanes extend between the bands. The bands and vanes define in part the hot gas path through the gas turbine. Each nozzle segment comprises an outer band portion and an inner band portion and one or more of the nozzle vanes extend between the outer and inner band portions. In current gas turbine designs, a cooling medium, for example, steam, is supplied to each of the nozzle segments to cool the parts exposed to the hot gas path. To accommodate the steam cooling, each band portion includes a nozzle wall in part defining the hot gas path through the turbine, a cover radially spaced from the nozzle wall defining a chamber therewith and an impingement plate disposed in the chamber. The impingement plate defines with the cover a first cavity on one side thereof for receiving cooling steam from a cooling steam inlet. The impingement plate also defines, along an opposite side thereof and with the nozzle wall, a second cavity. The impingement plate has a plurality of apertures for flowing the cooling steam from the first cavity into the second cavity for impingement cooling the nozzle wall. The cooling steam then flows radially inwardly through cavities in the vane(s), certain of which include inserts with apertures for impingement cooling the side walls of the vane. The cooling steam then enters a chamber in the inner band portion and reverses its flow direction for flow radially outwardly through an impingement plate for impingement cooling the nozzle wall of the inner band portion. The spent cooling medium flows back through cavities in the vane to an exhaust port of the nozzle segment.

It will be appreciated that in a current steam cooled nozzle segment design of the assignee hereof, an exit chimney is provided for flowing the spent cooling steam from the vane cavities past the nozzle wall, impingement plate and cover of the outer band portion to an exit port coupled to the outer band. In a current design, an exit chimney is integrally cast with the cover and extends radially inwardly into the exit openings of the cavities flowing the spent cooling steam radially outward. The integral exit chimney is first brazed about its margin to a margin of the impingement plate. Subsequently, this sub-assembly is brazed with the margin about the exit openings of the vane cavities. The primary joint between the nozzle wall about the vane cavities and the exit chimney requires a certain robustness due to the stresses across the joint and to the pressure difference on opposite sides of the exit chimney walls. It will be appreciated that the exit chimney on one side is exposed to inlet high pressure cooling steam and, on its opposite side, to exit hotter lower pressure spent cooling steam. There are also thermal and mechanical stresses that are taken up through the exit chimney.

In this current design, however, the primary joint between the exit chimney and nozzle wall is through a pair of brazed joints, one of which necessarily has to be formed as a blind joint. That is, the joint between the impingement plate and the nozzle side wall which is critical to the system must be formed after the sub-assembly of the cover and impingement plate is applied to the side wall. Thus, the current method of forming the joint results in a joint which is not robust and may be of reduced quality because it must be accomplished blindly.

Additionally, the joints of the current design cannot be inspected after fabrication. This is particularly important because brazed joints require finite gaps for proper brazing. If the manufacturing tolerances vary, e.g., 10–20 mils, a required gap appears only problematically because the final brazing gap is unknown and too large. Consequently, there is a need to improve the joint between the nozzle casting, the exit chimney and the nozzle cover in order to enhance the stress carrying capability of the joint and its capacity to be inspected and produced with consistency.

BRIEF SUMMARY OF THE INVENTION

According to a preferred embodiment of the present invention, the exit chimney is provided as a discrete part serving as a flow channel for receiving the spent cooling medium from the vane cavities and transmitting the cooling medium past the nozzle wall, impingement plate and cover into the exit port. The configuration of the exit chimney which may be a casting or fabrication and corresponding configuration of the nozzle wall, impingement plate and cover provide for both accessible and inspectable joints prior to and after the joints are formed. To accomplish the foregoing, the exit chimney is in the form of an endless sleeve shaped for reception in the margins of the vane cavity walls surrounding the exit cavities of the vane at one end with a generally corresponding configuration at its opposite end for forming end joints with the vane cavity wall and cover, respectively. A radially outwardly projecting rib is provided intermediate its ends for forming a joint with the impingement plate. Each of the three joints is accessible while being formed, is available for inspection after the joint is formed prior to forming the next joint and may be formed by brazing, E-beam or laser welding.

In accordance with this invention, the first joint is formed between the radial inner end of the exit chimney and a margin or rib surrounding the vane cavities which will deliver the spent cooling steam to the chimney for flow to the exit port. Thus, the inner end of the exit chimney is welded to the margin about the vane cavities from a location radially outwardly of the nozzle wall. This first joint can be formed as robust as necessary and is clearly accessible during and after formation. Subsequent to forming this first joint, the impingement plate is welded or brazed to a rib on the exit chimney intermediate opposite ends of the chimney. This joint likewise is accessible radially outwardly of the joint, both while forming the joint and subsequent to joint formation for inspection. Subsequent to forming the second joint, the third joint between the cover and the outer end of the exit chimney is formed. This joint likewise is accessible outwardly of the joint and can be inspected subsequent to joint formation. With the exit chimney joined to the nozzle segment and the cover applied, the exit port can be welded to the cover about the outer opening of the chimney, affording a through passage from the cavities, through the chimney, directly to the exit port.

In a preferred embodiment according to the present invention, there is provided in a gas turbine, a nozzle segment having outer and inner band portions and at least one vane extending between the band portions, one vane including at least first and second vane cavities, an exit chimney in the outer band portion in communication with the second vane cavity, at least the outer band portion including a nozzle wall defining in part a hot gas path through the turbine, a cover radially spaced from the nozzle wall of the outer band portion defining a chamber therebetween and an impingement plate disposed in the chamber to define with the cover a first plenum for receiving a cooling medium and with the nozzle wall a second plenum on a side of the impingement plate opposite the first plenum, the impingement plate having a plurality of apertures therethrough for flowing the cooling medium from the first plenum into the second plenum for impingement cooling the nozzle wall, the first vane cavity lying in communication with the second plenum for flowing the cooling medium along the vane to the inner band portion, the second vane cavity lying in communication with the inner band for flowing the cooling medium along the vane to the exit chimney, a first joint between one end of the exit chimney and margins of the vane about the second cavity, a second joint between the impingement plate and the exit chimney along the chimney intermediate one end and an opposite end of the chimney, the cover having an opening and a third joint at the opposite end of the exit chimney and the cover about the opening for flowing cooling medium through the exit chimney past the cover to an exit port.

In a further preferred embodiment according to the present invention, there is provided in a gas turbine having a nozzle segment comprised of outer and inner band portions and at least one vane extending between the band portions with at least one vane cavity extending along the vane, the outer band portion including a nozzle wall, a cover radially spaced from the nozzle wall defining a chamber therewith and an impingement plate in the chamber to define with the cover a first plenum for receiving a cooling medium and with the nozzle wall, a second plenum to receive cooling medium flowing through apertures in the impingement plate for impingement cooling the nozzle wall, a method of securing an exit chimney in the nozzle segment, comprising the steps of (a) securing one end of the exit chimney to the nozzle wall about a margin of the vane cavity at a first joint therebetween, (b) subsequent to step (a), securing margins of the impingement plate and the exit chimney to one another at a second joint along the chimney intermediate opposite ends of the chimney and (c) subsequent to step (b) securing an opposite end of the chimney and the cover to one another with the chimney in communication with the exit opening of the vane cavity.

DETAILED DESCRIPTION OF THE INVENTION

Figure 1:
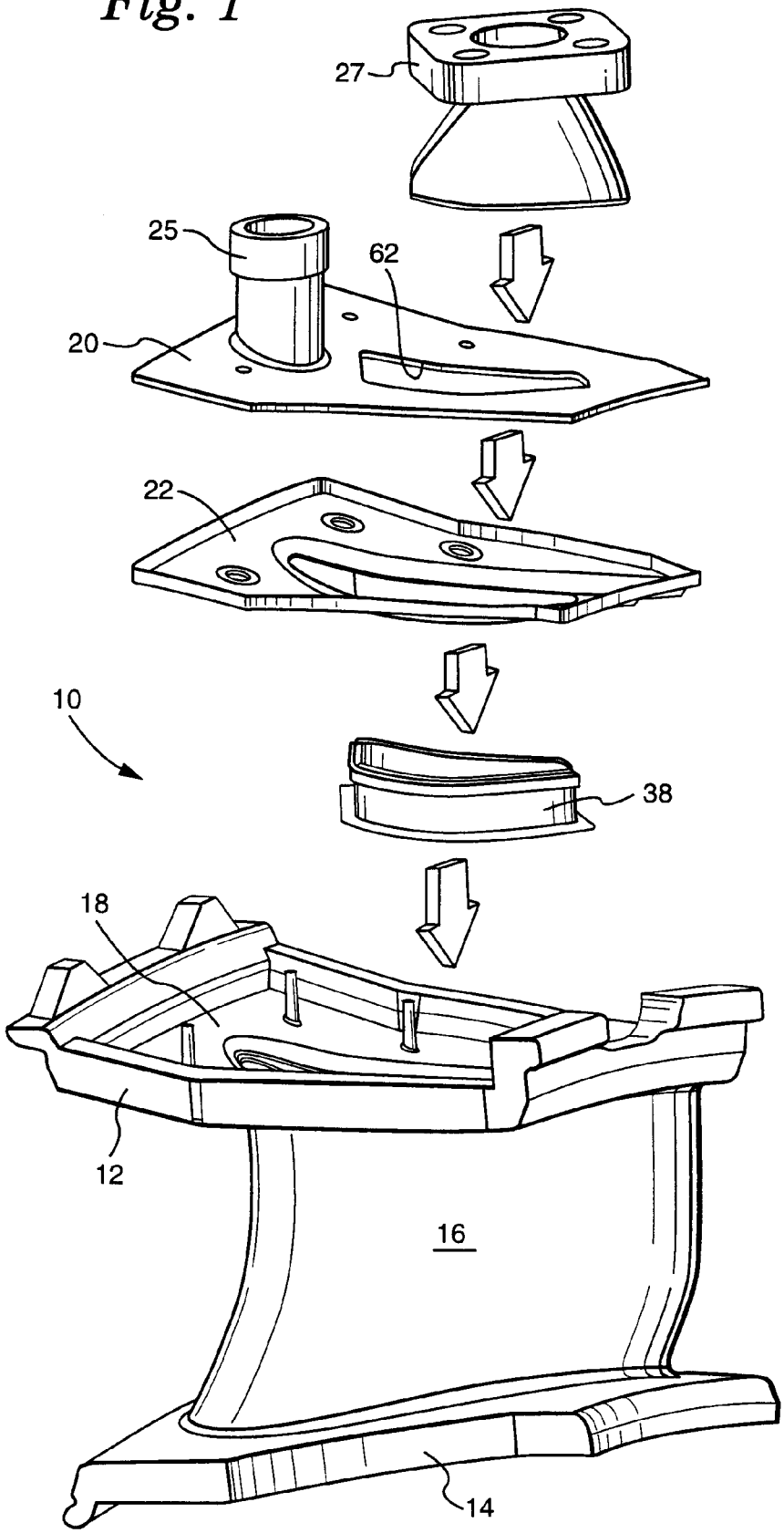
FIG. 1 is an exploded perspective view of a nozzle segment illustrating the assemblage of the exit chimney, impingement plate, cover and exit port to the outer band portion of the segment.
Figure 2:
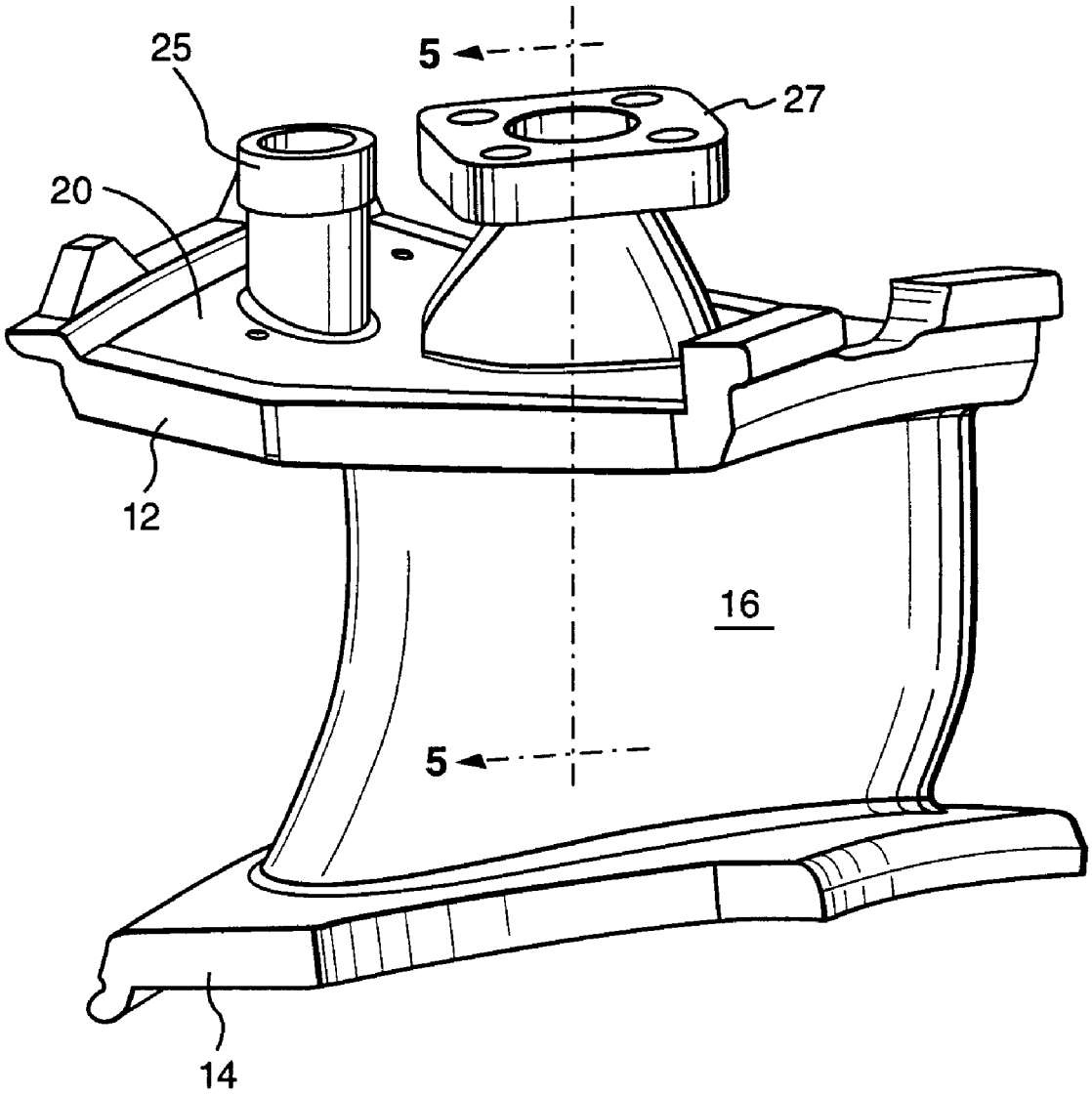
FIG. 2 is a perspective view of the nozzle segment after fabrication.

Referring now to FIG. 1, there is illustrated a nozzle segment, generally designated 10, forming one of an annular array of segments disposed about a gas turbine axis. Each nozzle segment includes an outer band portion 12, an inner band portion 14 and one or more vanes 16 extending therebetween. When the nozzle segments are arranged in the annular array, the outer and inner band portions 12 and 14 and vanes 16 define a portion of an annular hot gas path through the gas turbine, as is conventional.

Figure 3:
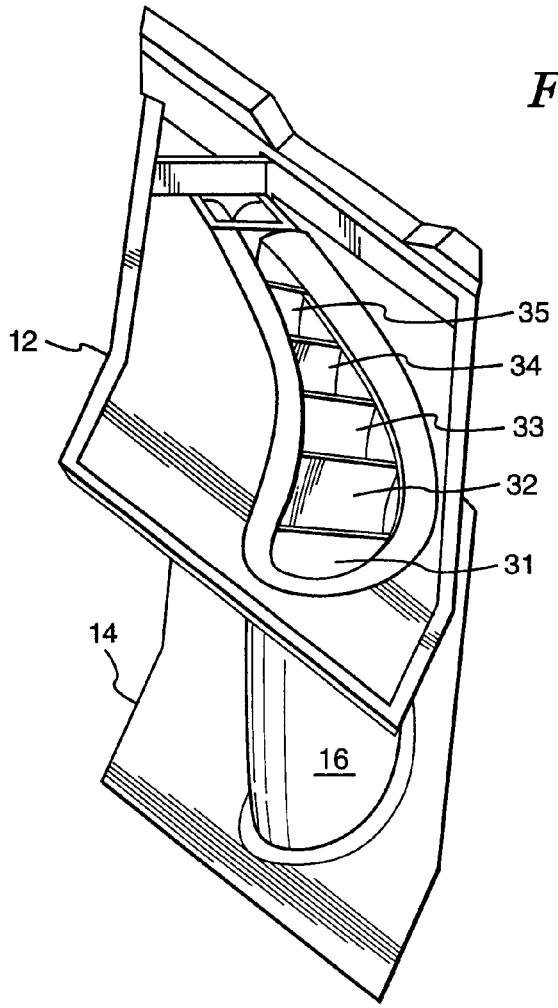
FIG. 3 is a perspective view of the outer band portion of the nozzle segment without the impingement plate, cover or exit port.

The outer and inner bands and the vanes are cooled by flowing a cooling medium, e.g., steam, through a chamber of the outer band portion 12 radially inwardly through cavities in the vanes, through a chamber in the inner band 14 and radially outwardly through the vanes for return of the cooling medium to an exit port along the outer band portion. More particularly and by way of example in FIG. 1, the outer band portion 12 includes an outer nozzle wall 18, an outer cover 20 which is disposed over and welded to the nozzle wall 18 to define a chamber 21 (FIG. 5) between cover 20 and nozzle wall 18. An impingement plate 22 is disposed in the chamber 21. Impingement plate 22 defines with the nozzle cover 20 a first plenum or cavity 24 (FIG. 5) and, on an opposite side thereof, defines with the nozzle wall 18 a second plenum or cavity 26. Referring back to FIG. 1, cooling medium inlet and outlet ports 25 and 27, respectively, are provided through the cover 20 for supplying the cooling medium, e.g., steam, to the nozzle vane segment and exhausting the spent cooling steam from the segment. The cooling steam supplied the first cavity 24 flows through a plurality of apertures 30 (FIG. 5) in the impingement plate 22 for impingement cooling of nozzle wall 18. The impingement cooling steam flows from the second cavity 26 into one or more inserts, not shown, in cavities extending through the vane between the outer and inner bands. Preferably, the cooling medium flows through the leading edge cavity 31 of the vane (FIG. 3) and the spent cooling medium flows radially outwardly through the vane cavities 32, 33, 34 and 35. The vane inserts include a plurality of apertures for impingement cooling the side walls of the vane. The cooling steam then flows into the chamber in the inner band 14 and particularly into the radially innermost cavity for flow through apertures of an impingement plate in the inner band portion for impingement cooling the nozzle side wall of the inner band portion. The spent cooling steam then flows through the cavities 32–35 in the vane and through an exit chimney 38, described below, for exit through the exhaust port 27. For a complete description of an embodiment of the foregoing described cooling circuit, reference is made to U.S. Pat. No. 5,634,766, of common assignee, the disclosure of which is incorporated herein by reference.

Figure 4:
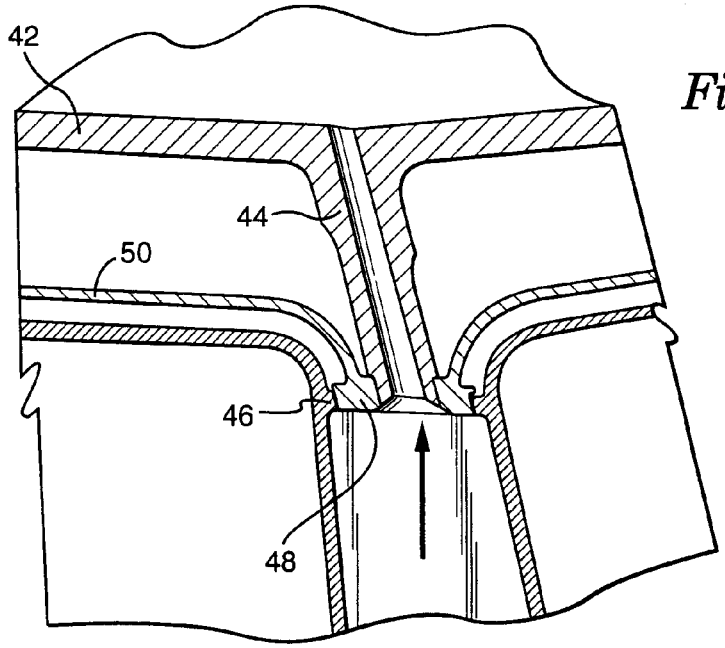
FIG. 4 is an enlarged fragmentary cross-sectional view illustrating a current chimney design and joints between the chimney, impingement plate and nozzle wall.

In a current design of the assignee hereof and illustrated in FIG. 4, the outer cover 42 includes the integrally formed exit chimney 44 for receiving the spent cooling steam from the vane cavities. The exit chimney extends down into the margin of the exit openings of the vane cavities 32–35 and is spaced from a rib 46 formed on the vane walls about the vane cavities. Between the distal end of the exit chimney 44 and the ribs 46 is a connecting bead 48 for the impingement plate 50. It will be seen that the juncture between the exit chimney 44 and the nozzle wall at rib 46 is interrupted by the bead 48 of the impingement plate 50. Moreover, because the impingement plate 50 is brazed or welded first to the distal end of the exit chimney 44, the joint between the rib 46 and the bead 48 must be made blind. Thus, the joint between the exit chimney and the nozzle wall cannot be of the desired robustness.

Figure 5:
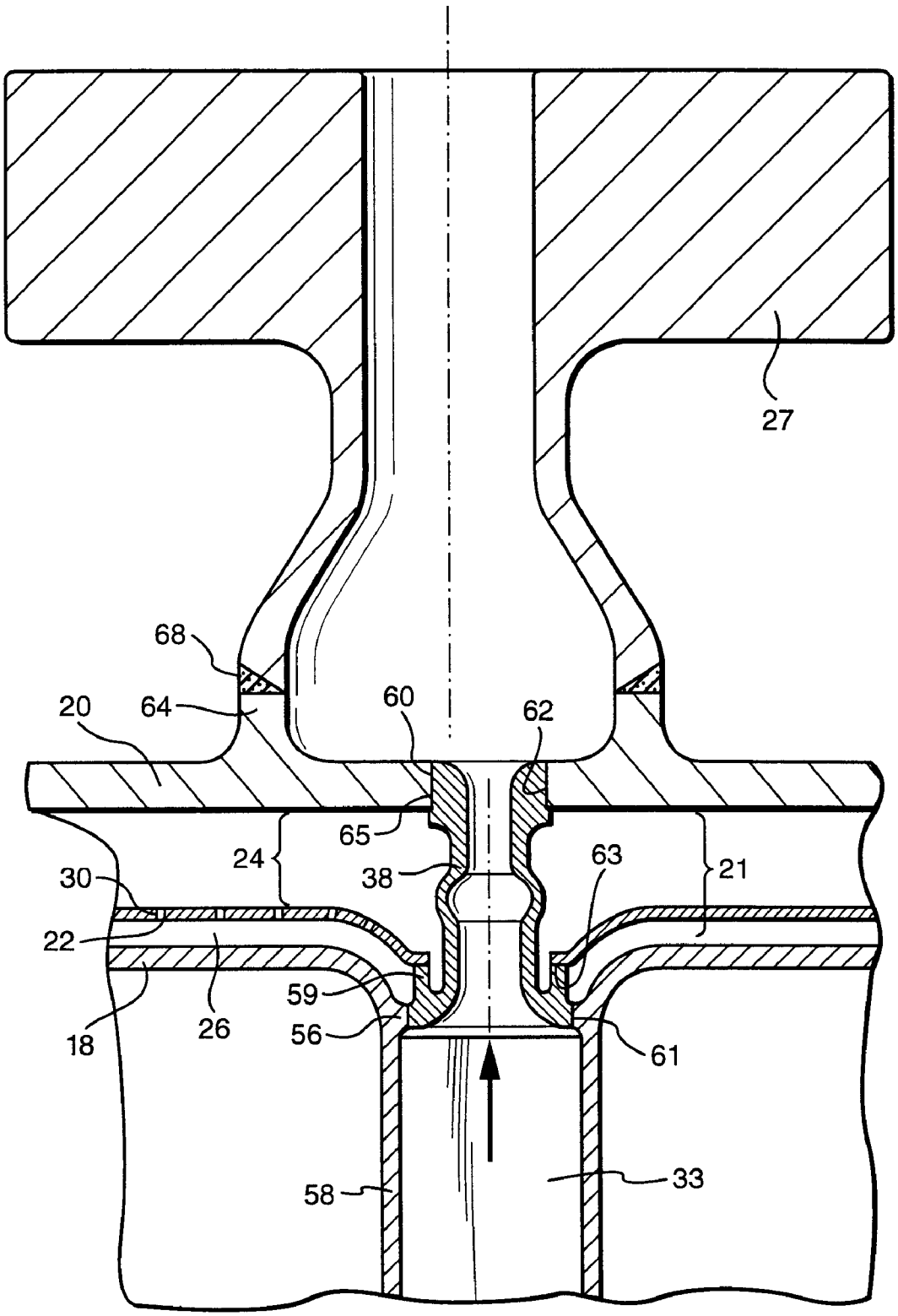
FIG. 5 is an enlarged cross-sectional view illustrating the exit chimney hereof in assembly in the nozzle segment.

Referring now to FIGS. 1 and 5, a preferred embodiment for an exit chimney 38 comprises a short endless sleeve open at opposite ends and configured at its inner end, i.e., cast at its inner end, to conform to the margin of the rib 56 about the vane wall 58. The exit chimney 38 also includes an upstanding rib 59 intermediate its opposite ends and extending about the entirety of the sleeve. The opposite or outer end of the sleeve 38 has a finished surface 60 for forming a joint with an opening 62 through the cover plate 20. Additionally, the cover plate 20 has an upstanding boss 64 to which the exit port 27 is secured.

With the foregoing configuration of the exit chimney 38, the fabrication of the exit chimney 38 into the nozzle segment is accomplished without the necessity of forming any blind joints and each joint formed is accessible before, during and after formation. Particularly, the exit chimney sleeve 38 is poised over the cavity vane openings 32–35 with the cover 20 and impingement plate 30 not yet secured to the segment. Thus, a first joint 61 between the inner end of the sleeve 38 and the rib 56 is fully visible and accessible and can be brazed or welded by E-beam or laser beam. Consequently, a robust joint can be formed between the chimney 38 and the nozzle wall. Subsequent to the formation of this first joint, a second joint 63 between the chimney 38 and the impingement plate 22 is formed. The second joint 63 is located at the juncture of the upstanding rib 59 and the margin of the impingement plate 22. As in the first joint, this second joint is fully exposed and accessible prior to and after its formation. With the exit chimney and impingement plate secured in the nozzle segment, a third joint 65 may be formed between the outer end of exit chimney 38 and the margin of the opening 62 through the cover 20. This third joint 65 likewise is fully accessible prior to, during and after welding and is therefore available for inspection after the completion of the joint. Finally, the exit port 27 is welded to the upstanding rib 64 of the cover as illustrated at 68 in FIG. 5, completing the exit opening for the spent cooling medium from the cavities 32–35 through the exit chimney 38, past the outer band and to the exhaust port.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine, a nozzle segment having outer and inner band portions and at least one vane extending between said band portions, said one vane including at least first and second vane cavities, an exit chimney in said outer band portion in communication with said second vane cavity, at least said outer band portion including a nozzle wall defining in part a hot gas path through the turbine, a cover radially spaced from said nozzle wall of said outer band portion defining a chamber therebetween and an impingement plate disposed in said chamber to define with said cover a first plenum for receiving a cooling medium and with said nozzle wall a second plenum on a side of said impingement plate opposite said first plenum, said impingement plate having a plurality of apertures therethrough for flowing the cooling medium from said first plenum into said second plenum for impingement cooling said nozzle wall, said first vane cavity lying in communication with said second plenum for flowing the cooling medium along said vane to said inner band portion, said second vane cavity lying in communication with said inner band for flowing the cooling medium along said vane to said exit chimney, a first joint between one end of said exit chimney and margins of said vane about said second cavity, a second joint between said impingement plate and said exit chimney along said chimney intermediate said one end and an opposite end of said chimney, said cover having an opening and a third joint at said opposite end of said exit chimney and said cover about said opening for flowing cooling medium through said exit chimney past said cover to an exit port.

2. A segment according to claim 1 wherein said vane has a third cavity, said chimney lying in communication with said third cavity for receiving cooling medium from said third cavity and flowing the cooling medium through said opening in said cover to said exit port.

3. A segment according to claim 1 wherein said chimney extends through said chamber of said outer band.

4. A segment according to claim 1 wherein said exit chimney comprises a casting.

5. In a gas turbine having a nozzle segment comprised of outer and inner band portions and at least one vane extending between said band portions with at least one vane cavity extending along said vane, the outer band portion including a nozzle wall, a cover radially spaced from the nozzle wall defining a chamber therewith and an impingement plate in said chamber to define with said cover a first plenum for receiving a cooling medium and with said nozzle wall a second plenum to receive cooling medium flowing through apertures in the impingement plate for impingement cooling the nozzle wall, a method of securing an exit chimney in the nozzle segment, comprising the steps of:

(a) securing one end of said exit chimney to said nozzle wall about a margin of said vane cavity at a first joint therebetween;

(b) subsequent to step (a), securing margins of said impingement plate and said exit chimney to one another at a second joint along said chimney intermediate opposite ends of said chimney; and (c) subsequent to step (b) securing an opposite end of said chimney and said cover to one another with the chimney in communication with the exit opening of said vane cavity.

6. A method according to claim 5 including securing an exit port to said cover.

* * * * *